United States Patent [19]

Holopainen

[11] Patent Number: 4,753,019

[45] Date of Patent: Jun. 28, 1988

[54] APPARATUS FOR DRYING AND HEATING MATERIAL IN A ROTARY KILN

[75] Inventor: Osmo Holopainen, Timola, Finland

[73] Assignee: A. Ahlstrom Corporation, Karhula, Finland

[21] Appl. No.: 947,740

[22] Filed: Dec. 30, 1986

[30] Foreign Application Priority Data

Dec. 30, 1985 [FI] Finland ..... 855172

[51] Int. Cl.[4] ..... F26B 11/04

[52] U.S. Cl. ..... 34/134; 34/135; 34/141; 34/142

[58] Field of Search ..... 34/130, 134, 135, 138, 34/142, 141

[56] References Cited

U.S. PATENT DOCUMENTS

| | | | |
|---|---|---|---|
| 532,553 | 1/1895 | Hentschel | 34/138 |
| 700,842 | 5/1902 | Smith | 34/138 |
| 2,090,177 | 8/1937 | Bill | 34/134 |
| 2,936,220 | 5/1960 | Bill et al. | 34/135 |
| 3,293,774 | 12/1966 | Baker | 34/134 |
| 3,391,471 | 7/1968 | Petterson | 34/134 |
| 4,393,603 | 7/1983 | Casperson | 34/134 |
| 4,612,711 | 9/1986 | Murray | 34/134 |

FOREIGN PATENT DOCUMENTS

| | | |
|---|---|---|
| 618085 | 8/1935 | Fed. Rep. of Germany . |
| 792052 | 12/1980 | U.S.S.R. . |

*Primary Examiner*—Larry I. Schwartz
*Attorney, Agent, or Firm*—Toren, McGeady & Associates

[57] ABSTRACT

An apparatus for drying and heating lime sludge in a rotary kiln by means of regenerative heat transfer. The apparatus is preferably formed of round or rounded rods which extend parallel to the longitudinal axis. The rods are disposed in the kiln in an annular region adjacent the housing wall so that lime sludge flows freely between the rods while the kiln is rotating.

13 Claims, 1 Drawing Sheet

APPARATUS FOR DRYING AND HEATING MATERIAL IN A ROTARY KILN

BACKGROUND AND SUMMARY OF THE INVENTION

The present invention relates to an apparatus for drying and heating material in a rotary kiln by means of regenerative heat transfer, and especially in kilns for reburning lime sludge.

Lime sludge is a term for a calcium carbonate sludge generated in a causticizer of a sulphate cellulose factory. This sludge is dried mechanically in a drum filter or in a drainage press before it is regenerated into calcium oxide in a rotary kiln.

Lime sludge from a drum filter usually has a 25–40% water content of the wet weight. The remaining water is removed by means of hot flue gases in a lime sludge reburning kiln. In order to make the heat transfer more effective, drying chains are usually used in the kiln. The chains function on a regenerative heat transfer principle storing heat from the gases and transmitting the heat to the lime sludge as the chains alternately contact the gases and the lime sludge, respectively, while the kiln is rotating around its axis.

A zone of chains has proved to be an effective means for heat transfer. It has, however, some disadvantages. For example, it is not advantageous to totally dry the lime sludge in the zone of chains, because dust begins to form in the kiln. Substantial quantities of the lime sludge may thus be disadvantageously discharged with the gas from the kiln. The development of drum filters for drying lime sludge mechanically has resulted in an increased dry solids content of the lime sludge before its entry into the kiln. Approximately 10 years ago, a typical dry solids content of lime sludge, after passage through the drum filter, was 65–70%. Today, however, it is an everyday phenomena to exceed a 70% dry solids content, and the best levels for the dry solids content are close to 80%. As noted previously, however, there is increased dust content in the discharge gases of the kiln caused by the action of the chains in the chain zone. When the kiln rotates, the chains swing and strike against each other and the almost completely dried lime sludge which clings to the chains comes loose in the flue gas atmosphere and is discharged with the flue gas.

The rest of the drying of the lime sludge takes place in the kiln part downstream of the chain zone. This part of the kiln usually has no inside protuberances or inwardly extending projections. The steel housing of the kiln is normally protected along its inside wall by means of a fire-resistant and isolating lining. Heat is transferred from the gas to the lime sludge bed surface in contact with the gas (i.e., the lime sludge bed surface/flue gas interface) and via the lined inner surface of the kiln to the lower bed surface contacting the lining (i.e., the bed bottom/flue gas interface). Heat is primarily transferred by radiation, but also in part by convection.

Dry lime sludge is finely powdered and very light (the density of calcium carbonate is about 2.7 t/m$^3$, the bulk density of dry lime sludge is only 0.7–0.8 t/m$^3$). The friction between the lime sludge bed and the lining, as well as the interior friction of the materials of the bed, are very small. Consequently, the bed behaves almost like water. The bed slips against the lining and its surface cannot renew. Because of this, the lime sludge surface that is contacting the gas and also its surface in contact with the lining are heated to a temperature that is considerably higher than the average temperature of the bed. This is also partly due to a low thermal conductivity resulting from the "porousness" of the bed. This situation obtains until the alkali salts start melting and forming grain. A grainy bed behaves normally in the kiln: the bulk density of the bed increases, the friction of the bed becomes sufficiently large to renew the surface of the bed and the temperature of the bed decreases. Heat transfer from the gas becomes more effective and the mixing of the bed takes place with sufficient effectiveness. This bed temperature at which the situation starts to improve is about 500° C.

Lifters, for example, scoops, fixed on the inner periphery as in known drum dryers and some other kilns (e.g., expanded clay kilns) have lately been used in lime sludge kilns. By means of these lifters, the bed is mixed and its surface allowed to renew. Some sludge, however, adheres to these scoops depending on their configuration. When each scoop is elevated to its uppermost position in the kiln due to the rotation of the kiln, lime sludge falls from the scoop into the flue gas and thus adds to the formation of dust. Also, the mass of the scoops is usually so small that regenerative heat transfer is not as efficiently accomplished with them as is with drying chains.

According to the present invention, there is provided an apparatus for heating and drying material, for example, lime sludge, in a rotary kiln which functions on a regenerative heat transfer principle and at the same time mixes the bed effectively so that the surface is continuously renewed. It also provides more even temperature distribution throughout the bed and reduces the formation of dust and hence the quantity of material discharged with the flue gas. Such apparatus, according to the present invention, may comprise a housing and a plurality of rods disposed within the housing and spaced therefrom and one from the other. Preferably, the apparatus comprises rods that are circumferentially spaced one from the other and generally parallel with the longitudinal axis of the cylindrical housing whereby the rods are in alternate contact with the gas and lime sludge bed while the kiln rotates. When in the bed, the rods advantageously and effectively mix it. When in the gas, the preferred round form of the rods inhibits any scooping action and permits only a small amount of such lime sludge to adhere to the rods. Thus, when the sludge falls from the rods, only a minimum amount becomes mixed with the gas and only minimally adds to the formation of dust in the kiln. The effect of the regenerative heat transfer is primarily dependent on the mass of the rods. It is believed possible to provide a rod weight per kiln meter as large as the weight of the chain zone without incurring the deleterious effects of the chains noted previously.

According to the present invention, the circumferentially-spaced axially extending rods lie in an annular region extending from the interior wall of the housing inwardly toward the central axis a distance at least 15% but no greater than 40%, and preferably 30%, of the diameter of the housing. While the preferred form of the rods is that of a solid circular cross-section, other shapes are possible, for example, rods having a square or droplet shaped cross-section may be used. In those latter cases, the orientation of the rods is in a direction to facilitate movement of the rods through the bed with minimum adhesion of the material to the rods consistent with good regnerative heat transfer characteristics between the rods and the material. Thus, the tips or apices are oriented or faced in the direction of rotary movement of the rods through the bed.

It is therefore a primary object of the present invention to provide for efficient heating and drying of material in a rotary kiln operable on a regenerative heat transfer principle. These and other objects and advantages of the present invention will become apparent from the ensuing detailed description of the present invention, appended claims and drawings wherein:

DETAILED DESCRIPTION OF THE PRESENT INVENTION

Figure 1:
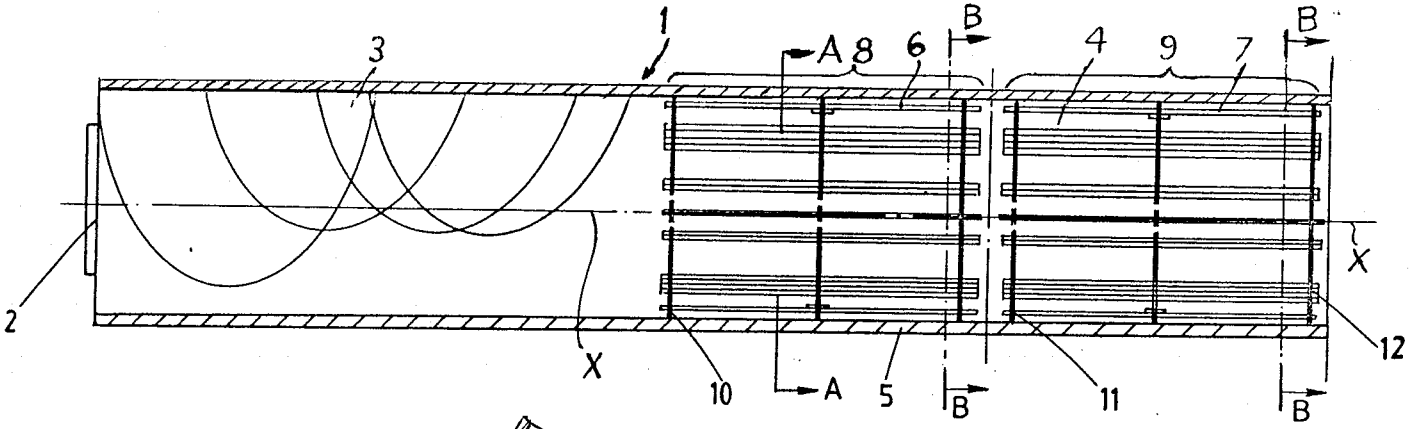
FIG. 1 is a schematic vertical cross-sectional view of a preheating and drying part of a rotary kiln constructed in accordance with the present invention.

The present invention has applicability to the heating and drying of a wide variety of materials, and, while this description is particularly applicable to heating and drying of lime sludge, it will be appreciated that the invention is not limited to that material. In FIG. 1, there is illustrated a dryer part 1 including a generally cylindrical housing having an elongated central axis X—X disposed on the upstream side of a reburning zone, not shown, in a rotary lime sludge kiln. At the illustrated end of the kiln, there is disposed an inlet 2, through which the lime sludge is fed into the dryer part 1 by means of a feeding apparatus, not shown. The kiln is conventionally mounted on bearings or rotating rolls in an inclined position so that the material to be handled in the kiln flows downwardly, i.e., in an axial flow direction from inlet 2 toward the opposite end of the kiln. The drying part comprises two parts: a chain zone 3 and a rod zone 4. Part of the rod zone functions as a preheating zone for the lime sludge in an area where the temperature of the lime sludge is below 500° C.

Figure 2:
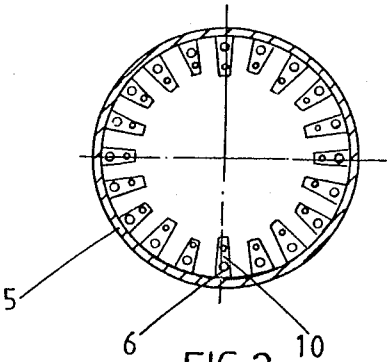
FIG. 2 is a sectional view taken along the line A—A of FIG. 1.

In a preferred embodiment, rods 6 and 7 lie parallel with the longitudinal or central axis X—X of the kiln and are disposed in two axially spaced groups 8 and 9 in a region in the vicinity of the inner surface or wall of the housing 5 of the kiln. The upstream ends of the rods are supported in the housing 5 by means of circumferentially-spaced supports 10 fixed to the interior wall of the housing as illustrated in FIG. 2. The downstream ends of the rods are supported by an annular separation wall 11 and 12 forming a threshold as illustrated in FIG. 3.

Figure 3:
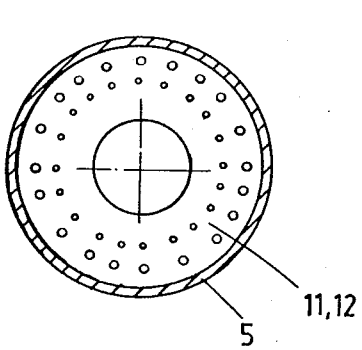
FIG. 3 is a sectional view taken along the line B—B of FIG. 1.

As illustrated in both FIGS. 2 and 3, the rods are disposed within the kiln so that they are situated in an annular region extending from the inner surface or interior wall of the kiln housing inwardly in a radial direction for a distance about 15–40%, preferably 30%, of the diameter of the housing. Additionally, the rods are spaced radially and circumferentially one from the other.

The distance between the rods and the kiln housing and the distance between the rods in the housing must be sufficiently great that the material forming the bed can flow relatively freely between the rods while the kiln is rotating. If the flow is obstructed, the rods undesirably start to function like lifters or scoops. That will result in a decrease in the regenerative heat transfer and an increase in the formation of dust in the kiln. A suitable free distance between the rods both in the radial and circumferential directions is 50–150 mm. Preferably, a 50 mm diameter round rod is used, the pitch being 100–200 mm.

Figure 4:
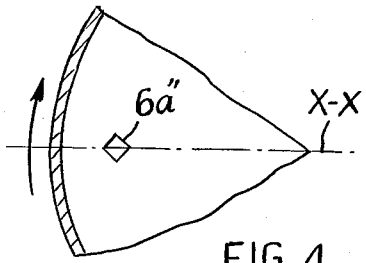
FIG. 4 is an enlarged fragmentary end elevational view of a portion of the housing illustrating a rod having a square cross-section.
Figure 5:
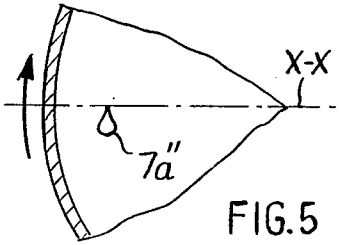
FIG. 5 is a view similar to FIG. 4 illustrating a rod having a droplet cross-section.

The cross-section of the rods is preferably round, although square or droplet-shaped rods may be used. A rod *6a* having a square cross-section is illustrated in FIG. 4. It is positioned such that, in cross-section, a pair of the opposed square apices or tips lie in the direction of circumferential movement of the kiln. Thus, one pair of opposed apices or tips lie in a radial plane passing through such apices and the central axis of the housing. The second pair of opposed apices of the square rod therefore lie in plane normal to the first-mentioned plane. A rod *7a* having a droplet-shaped cross-section is illustrated in FIG. 5 and positioned so that the tip of the droplet points tangentially of the rotational direction of motion of the kiln such that the tip leads the droplet-shaped rod through the bed. In both cases, the rods are oriented such that the tips facilitate movement through the bed and lead the rods through the bed in the direction of rotary movement. It will be appreciated, of course, that the preferred round cross-sectional shape of the rods likewise facilitates movement through the bed with minimum dust formation and maximum heat regenerative transfer.

The support of the lower end of a rod group disposed in the cross-section of the kiln is constructed, as illustrated in FIG. 3, to form a threshold, taking care that the degree of fullness upstream of the threshold is sufficient. By sufficient is meant that all rods in their turn extend within the bed, otherwise they are unable to function using the regenerative heat transfer principle.

The rod zone 4 is disposed in the lime sludge kiln in an area where the temperature of the bed (lime sludge) is below 500° C.

It will be appreciated that the rods may form rings positioned perpendicular to the longitudinal axis and spaced longitudinally one from the other in the direction of the axis.

It will thus be appreciated that according to the present invention an apparatus is provided for drying and heating material in a rotary kiln by means of a regenerative heat transfer and which, at the same time, effectively mixes the bed to provide for the continuous renewal of its surface, even distribution of temperature throughout the bed and a reduction in the formation of dust and, hence, the quantity of material discharged with the flue gas. While the invention has been herein shown and described in what is presently conceived to be the most practical and preferred embodiment thereof, it will be apparent to those of ordinary skill in the art that many modifications may be made thereof within the scope of the invention, which scope is to be afforded the broadest interpretation in the appended claims so as to encompass all equivalent apparatus.

It is claimed:

1. Apparatus for drying and heating material in a rotary kiln by regenerative heat transfer comprising an elongated housing and a plurality of solid rods free of outward projections disposed within said housing and spaced completely therefrom and one from the other, said housing is cylindrically shaped and has a central axis and a diameter, said rods extending within said housing in the same general direction as said central axis, said rods are circumferentially spaced apart from one another, said housing has an interior wall, said rods disposed in an annular region spaced inwardly from said interior wall toward said central axis at a distance in the annular region in the range of 15% to 40% of the diameter of said housing.

2. Apparatus according to claim 1 wherein said distance is about 30% of the diameter of said housing.

3. Apparatus according to claim 1 wherein said housing has an inlet adjacent one end for receiving material for flow in a direction parallel to said central axis, at least one annular partition wall extending in said annular region from said interior wall inwardly toward said central axis a distance at least 15% of the diameter of said housing.

4. Apparatus according to claim 1 wherein said rods are formed of a material having substantial heat conductivity and heat capacity.

5. Apparatus according to claim 1 wherein said rods have a generally circular cross-section.

6. Apparatus according to claim 1 wherein said rods have a generally square cross-section.

7. Apparatus according to claim 1 wherein said rods have a droplet-shaped cross-section.

8. Apparatus according to claim 1 wherein said rods having a generally square cross-section and disposed such that each rod has a pair of opposed apices lying in a radial plane passing through said apices and said central axis of said housing and other pair of opposed lying in a plane normal to said first mentioned plane.

9. Apparatus according to claim 1 wherein said housing being rotatable about said central axis in a predetermined rotary direction, each of said rods having a droplet configuration in cross-section such that the tip of the droplet configuration extends in a direction tangent to the direction of rotary movement of said droplet configured rod.

10. Apparatus for drying and heating material in a rotary kiln by regenerative heat transfer comprising a cylindrical shaped housing for the material having an elongated axis and an interior wall, a plurality of rods elongated in the direction of the axis of said housing and spaced circumferentially one from the other about said housing and spaced radially inwardly from said wall, means for supporting said rods in said housing, said support means includes adjacent the upstream end of said rods a plurality of circumferentially spaced brackets secured to and extending inwardly from the interior of said housing, said support means adjacent the downstream end of said rods includes an annular partition wall extending radially inwardly from said housing wall, and said partition wall extends inwardly from said interior wall toward said central axis a distance at least comparable to the distance the annular region extends from said interior wall.

11. Apparatus according to claim 11 wherein said support means includes adjacent the upstream end of said rods a plurality of circumferentially spaced brackets secured to the interior of said housing.

12. Apparatus according to claim 10 wherein said support means adjacent the downstream end of said rods includes an annular partition wall extending radially inwardly from said housing wall.

13. Apparatus according to claim 12 wherein said partition wall extends inwardly from said interior wall toward said central axis a distance at least comparable to the distance the annular region extends from said interior wall.

* * * * *